US009114503B2

(12) United States Patent
Hiraga et al.

(10) Patent No.: US 9,114,503 B2
(45) Date of Patent: Aug. 25, 2015

(54) NOZZLE, A NOZZLE UNIT, AND A BLASTING MACHINE

(75) Inventors: Mikitoshi Hiraga, Aichi (JP); Ryoichi Tsunoda, Aichi (JP); Kenichiro Inagaki, Aichi (JP); Kazuyoshi Maeda, Aichi (JP); Yukinori Suzuki, Kitanagoya (JP); Norihito Shibuya, Kitanagoya (JP)

(73) Assignee: 1. SINTOKOGIO, LTD., Nagoyi-Shi (JP)

( * ) Notice: Subject to any disclaimer, the term of this patent is extended or adjusted under 35 U.S.C. 154(b) by 470 days.

(21) Appl. No.: 12/937,128

(22) PCT Filed: Apr. 10, 2009

(86) PCT No.: PCT/JP2009/057373

§ 371 (c)(1),
(2), (4) Date: Oct. 8, 2010

(87) PCT Pub. No.: WO2009/131020

PCT Pub. Date: Oct. 29, 2009

(65) Prior Publication Data

US 2011/0028075 A1 Feb. 3, 2011

(30) Foreign Application Priority Data

Apr. 23, 2008 (JP) ..... 2008-111998
Apr. 3, 2009 (JP) ..... 2009-091456

(51) Int. Cl.
*B24C 5/04* (2006.01)
*B24C 3/08* (2006.01)
(Continued)

(52) U.S. Cl.
CPC ... *B24C 3/04* (2013.01); *B24C 1/08* (2013.01); *B24C 3/12* (2013.01); *B24C 5/02* (2013.01); *B24C 5/04* (2013.01)

(58) Field of Classification Search
CPC ..... B24C 5/02; B24C 5/04; B24C 3/08; B24C 3/083; B24C 3/12; B24C 3/22; B24C 3/28
USPC ..... 451/39, 40, 81, 102
See application file for complete search history.

(56) References Cited

U.S. PATENT DOCUMENTS 3,212,217 A * 10/1965 Furgason ..... 451/90
4,704,826 A * 11/1987 Kirkland ..... 451/76
(Continued)

FOREIGN PATENT DOCUMENTS

CN 1263487 8/2000
CN 101031389 A 5/2007
(Continued)

OTHER PUBLICATIONS

Chinese Patent Office, Chinese Office Action, Mar. 8, 2012, 3 pages.
(Continued)

*Primary Examiner* — Eileen Morgan
(74) *Attorney, Agent, or Firm* — Finnegan, Henderson, Farabow, Garrett & Dunner, L.L.P.

(57) ABSTRACT

A nozzle, a nozzle unit having a plurality of nozzles, and a blasting machine equipped with the nozzle unit, which can achieve a micro-machining with a high precision and a high productivity for the blasting process. A portion for escape 13*c* is formed at the distal end of the ejecting portion 13 of the nozzle 11, so if the distance between the surface of the work and the nozzle 11 is shortened to suppress the broadening of the flow of the abrasives, the reflected abrasives do not remain within the space between the surface of the work and the distal end of the ejecting portion 13. Thus, a blasting process with a high precision can be achieved. Further, since two nozzles 11*m* and 11*n* can be arranged so as to correspond to the width of the surface of the work to be processed by a rotational device 16, it is possible to blast a wider area of the surface of the work while the nozzle unit 10 or the blasting machine 20 sweep one time. Thus, the high productivity of the blasting process can be achieved.

2 Claims, 8 Drawing Sheets

(51) Int. Cl.

| | |
|---|---|
| ***B24C 3/12*** | (2006.01) |
| ***B24C 3/04*** | (2006.01) |
| ***B24C 1/08*** | (2006.01) |
| ***B24C 5/02*** | (2006.01) |

(56) References Cited

U.S. PATENT DOCUMENTS

| | | | | | |
|---|---|---|---|---|---|
| 5,165,602 | A * | 11/1992 | Arnout et al. | 239/8 |
| 5,201,150 | A * | 4/1993 | Kuboyama et al. | 451/88 |
| 5,405,283 | A * | 4/1995 | Goenka | 451/39 |
| 5,512,005 | A * | 4/1996 | Gulling | 451/29 |
| 5,599,223 | A * | 2/1997 | Mains, Jr. | 451/39 |
| 5,681,206 | A * | 10/1997 | Mesher | 451/39 |
| 5,779,523 | A * | 7/1998 | Mesher | 451/93 |
| 5,885,133 | A * | 3/1999 | Williams, Jr. | 451/40 |
| 5,931,721 | A | 8/1999 | Rose et al. | |
| 5,944,581 | A * | 8/1999 | Goenka | 451/39 |
| 6,203,406 | B1 * | 3/2001 | Rose et al. | 451/39 |
| 6,315,639 | B1 * | 11/2001 | Kipp | 451/38 |
| 7,442,112 | B2 * | 10/2008 | Yoon | 451/8 |
| 7,556,554 | B2 * | 7/2009 | Brug et al. | 451/2 |
| 7,762,869 | B2 * | 7/2010 | Yoon | 451/8 |
| 2005/0266777 | A1 * | 12/2005 | Yoon | 451/40 |
| 2006/0079157 | A1 * | 4/2006 | Van Brug et al. | 451/42 |
| 2006/0089090 | A1 * | 4/2006 | Johnson et al. | 451/40 |
| 2011/0059681 | A1 * | 3/2011 | Bowers et al. | 451/39 |

FOREIGN PATENT DOCUMENTS

| | | | |
|---|---|---|---|
| CN | 2915374 | Y | 6/2007 |
| CN | 101015909 | A | 8/2007 |
| JP | 7-42605 | | 10/1995 |
| JP | 2001-332748 | | 11/2001 |
| JP | 2003-291067 | | 10/2003 |
| JP | 2004122249 | | 4/2004 |
| JP | 2004-136181 | | 5/2004 |
| JP | 2006-224205 | | 8/2006 |
| TW | 403691 | | 9/2000 |
| WO | WO 99/02307 | | 1/1999 |

OTHER PUBLICATIONS

International Search Report dated Jul. 14, 2009 issued in corresponding application No. PCT/JP2009/057373.

Chinese Patent Office, Office Action issued in Chinese application 2009 80109521.8, Feb. 20, 2013, 3 pages.

European Patent Office, "Office Action," Extended European Search Report, Dec. 12, 2014, 3 pages.

* cited by examiner (A)

(B)

| Evaluation for Removal of Thin Films | Images |
|---|---|
| × |   |
| ○ |  |

Note: Black Areas are Blasted; White Areas are Non-Blasted

| Evaluation for Flaws on Thin Films | Images |
|---|---|
| × |  |
| ○ |  |

NOZZLE, A NOZZLE UNIT, AND A BLASTING MACHINE

TECHNICAL FIELD

This invention relates to a nozzle capable of micro-machining without masking, a nozzle unit having a plurality of the nozzles, and a blasting machine equipped with the nozzle unit, which are used for a blasting process to blast abrasives toward a work.

BACKGROUND OF THE INVENTION

Conventionally, a blasting process is used for the technical field of treatments for surfaces of works, such as removing burrs, roughening the surfaces of works, and removing flow marks of castings. Recently, it has also been used for the technical field of micro-machining. Namely, it is used for the working parts of semiconductors, electronic components, liquid crystals, etc. Since the blasting process is a kind of a dry process, no treatment for waste liquids, such as etching agents, is required. Thus, the effects on the environment can be reduced. Further, since the processes for the treatments for surfaces of works can be simplified, a low-cost processing can be achieved. As an example for applying the blasting process to the technical field of the micro-machining, Patent Document 1 discloses a technology for applying the blasting process to the micro-machining for substrates used for solar cell modules.

Patent Document 1: Japanese Patent Application Laid-open Publication No. 2001-332748

DISCLOSURE OF INVENTION

Generally, the method that comprises a step for putting a masking sheet on the working surface of a work, which sheet has a pattern to be micro-machined by the blasting process, and a step for blasting abrasives toward the masking sheet, is used for micro-machining a work. When the work is micro-machined by the blasting process without the masking sheet, it is necessary to blast abrasives toward the surface of the work so that the boundary between the processed area and the non-processed area becomes clear by suppressing the broadening of the flow of the abrasives blasted from a nozzle. To suppress the broadening of the flow of the abrasives, it is effective to shorten the distance between the surface of the work and the nozzle by moving the nozzle closer to the surface. However, when that distance is shortened, a disturbed flow is formed between the distal end of the nozzle and the surface of the work by those abrasives that bounce back from the surface. Thus, there is a problem associated with the difficulty in controlling the blasting depth and the roughness of the surface of the work. Further, to suppress the broadening of the flow of the abrasives, if the diameter of the nozzle is reduced, the area processed by one sweep of the nozzle is also reduced. Thus, there is also a problem associated with the lowered productivity of the blasting process.

The purpose of the present invention is to provide a nozzle, a nozzle unit having a plurality of nozzles, and a blasting machine equipped with the nozzle unit, that can achieve in the blasting process a micro-machining with a high precision and a high productivity.

To achieve that purpose, the first invention is constituted of the following:

A nozzle used for a blast processing by blasting abrasives toward the surface of a work, comprising the following:

an ejecting portion having an ejecting port for blasting abrasives, which portion is located at the distal end of the nozzle, and a portion for allowing the abrasives to escape ("a portion for escape"), which surrounds the ejecting portion, wherein the portion for escape is formed so that the outer diameter of the cross section of the portion, which is perpendicular to the flow of the blasted abrasives, is continuously decreased toward the ejecting port, and wherein the portion can prevent the abrasives that are blasted toward the surface of the work and are reflected from the surface from remaining within the space between the surface of the work and the distal end of the ejecting portion because of any collision of the reflected abrasives with the distal end of the ejecting portion.

By the first invention, since the portion is formed, which portion can prevent the abrasives that are blasted toward the surface of the work and are reflected from the surface from remaining within the space between the surface of the work and the distal end of the ejecting portion because of the collision of the reflected abrasives with the distal end of the ejecting portion, if the distance between the surface of the work and the nozzle is shortened to suppress the broadening of the flow of the abrasives, the reflected abrasives do not remain within the space between the surface of the work and the distal end of the ejecting portion. Thus, the blasting process with a high precision can be achieved.

The wording "the outer diameter of the portion for escape is continuously reduced" means that the outer diameter of the portion does not increase toward the distal end of the ejecting port, and that the outer diameter of the portion for escape becomes smallest at the distal end of the ejecting port. Namely, the portion for escape may have an area that has a constant outer diameter and a step-wise configuration.

For the second invention, the nozzle of the first invention is constituted of the following:

wherein the portion for escape has a conical surface having an apex angle of 50~70°.

By the second invention, since the portion for escape has a conical surface having an apex angle of 50~70°, the reflected abrasives can easily escape from the space between the surface of the work and the distal end of the ejecting portion.

For the third invention, the nozzle of the first invention is constituted of the following:

wherein the portion for escape is formed around the outer surface of at least one ejecting pipe having a constant outer diameter, and wherein the outer diameter of the ejecting pipes near their distal ends is smaller than that near its proximal end.

By the third invention, since the portion for escape is formed around the outer surface of at least one ejecting pipe having a constant outer diameter, and since the area of the outer diameter of the ejecting pipe near its distal end is smaller than that near its proximal end, the reflected abrasives can easily escape from the space between the surface of the work and the distal end of the ejecting portion.

For the fourth invention, a nozzle unit having a plurality of the nozzles of any one of the first, second, and third inventions is constituted of the following:

a support member for supporting the plurality of nozzles in parallel so that the nozzles can blast the abrasives perpendicularly toward the surface of the work, and a rotational device for rotating the support member about an axis perpendicular to the surface of the work.

By the fourth invention, since the nozzle unit comprises the rotational device for rotating the support member, which supports the plurality of nozzles in parallel, about an axis perpendicular to the surface of the work, the plurality of nozzles can be arranged so as to correspond to the width of the surface of the work to be processed. Thus, since it is possible to blast a wider area of the surface of the work by one sweep of the nozzle unit, the productivity of the blasting process can be improved. Namely, both machining with a high precision and the high productivity of the blasting process can be achieved.

For the fifth invention, a blasting machine having the nozzles of any one of the nozzles of the first, second, and third inventions can blast the abrasives toward a surface of a work from the nozzles, and can carry out the blast processing of the surface of the work while sweeping the nozzles over the work.

By the fifth invention, a blasting machine that has the same effects as those of the first, second, or third invention can be achieved.

For the sixth invention, a blasting machine having the nozzle unit of the fourth invention can blast the abrasives toward a surface of a work from nozzles, and can carry out the blast processing of the surface of the work while sweeping the nozzles over the work.

By the sixth invention, a blasting machine that has the same effect as that of the fourth invention can be achieved.

PREFERRED EMBODIMENT OF THE INVENTION

First Embodiment

Figure 1:
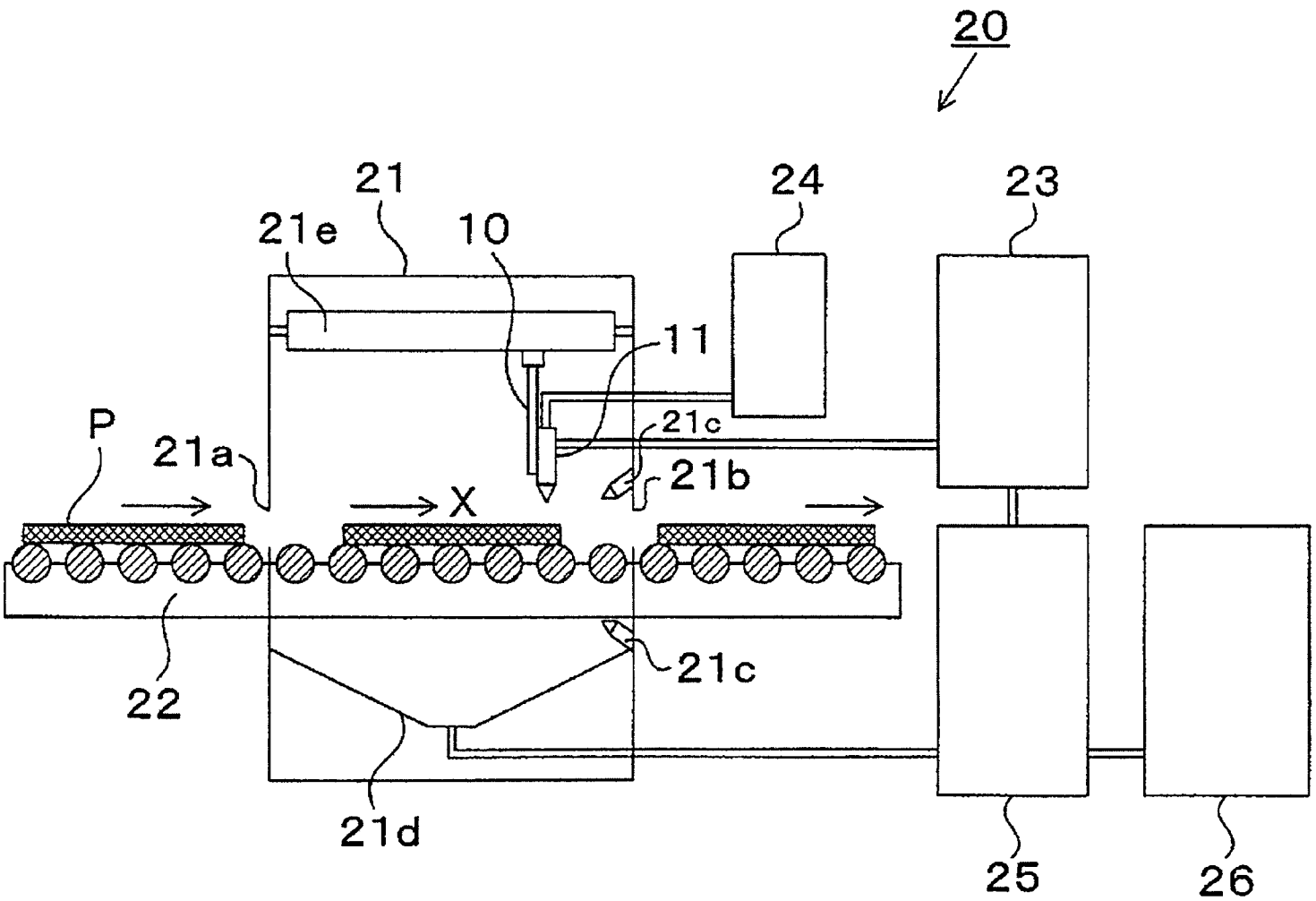
FIG. 1 is an illustrative drawing of the blasting machine, which drawing shows the constitution of the machine.
Figure 2:
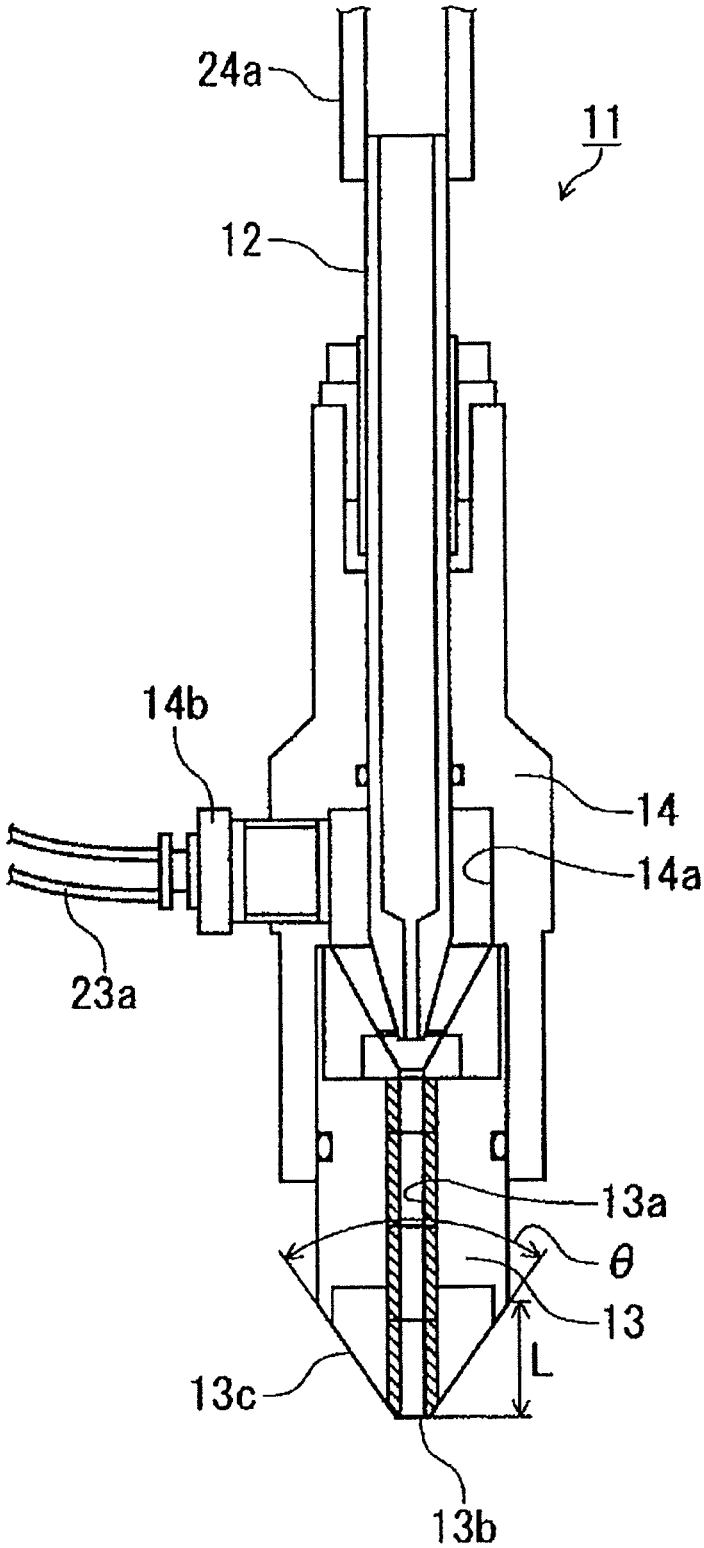
FIG. 2 is an illustrative drawing of the nozzle, which drawing shows the constitution of the structure of the nozzle.
Figure 3:
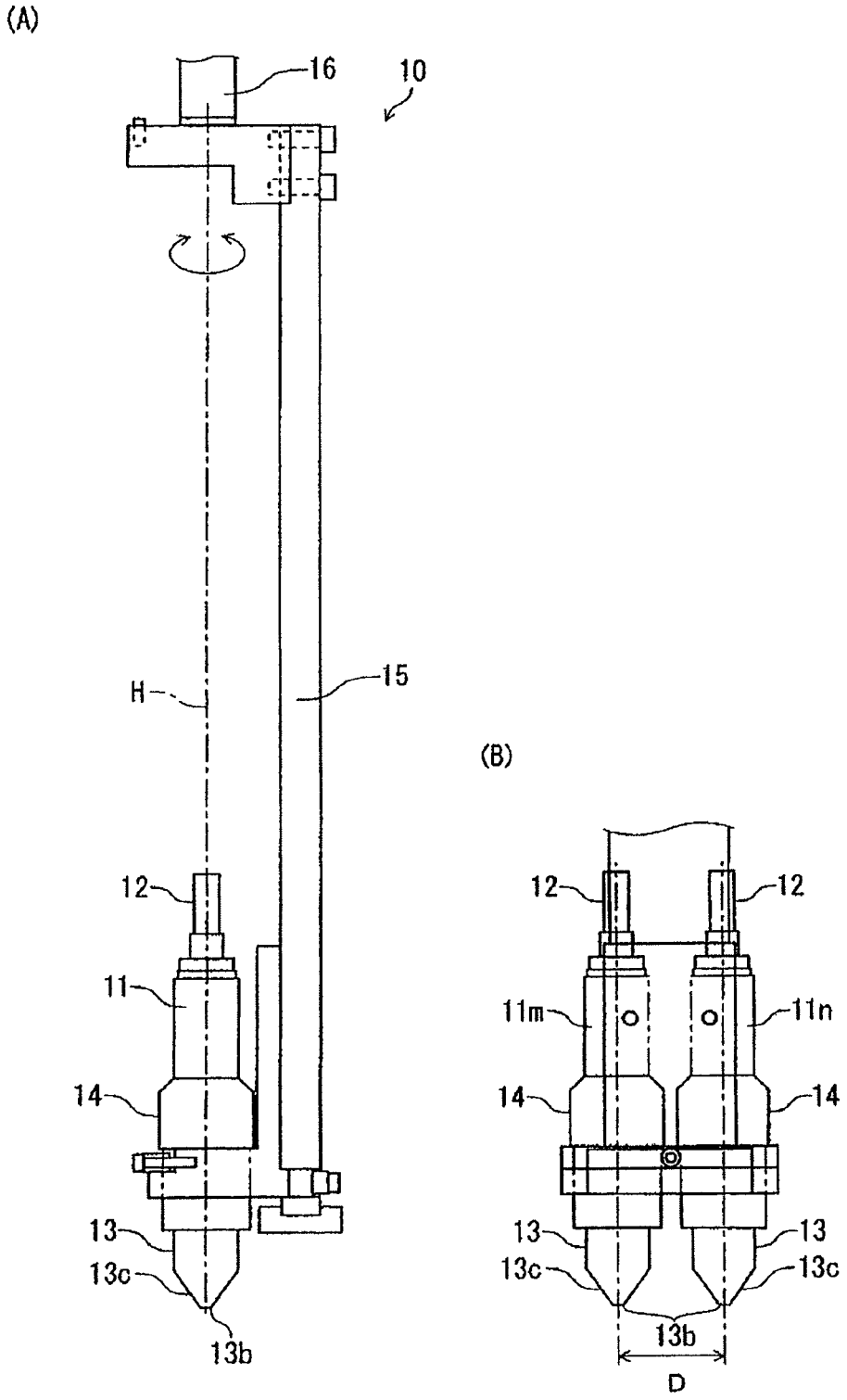
FIG. 3 is an illustrative drawing of the nozzle unit, which drawing shows the constitution of the nozzle unit.
Figure 4:
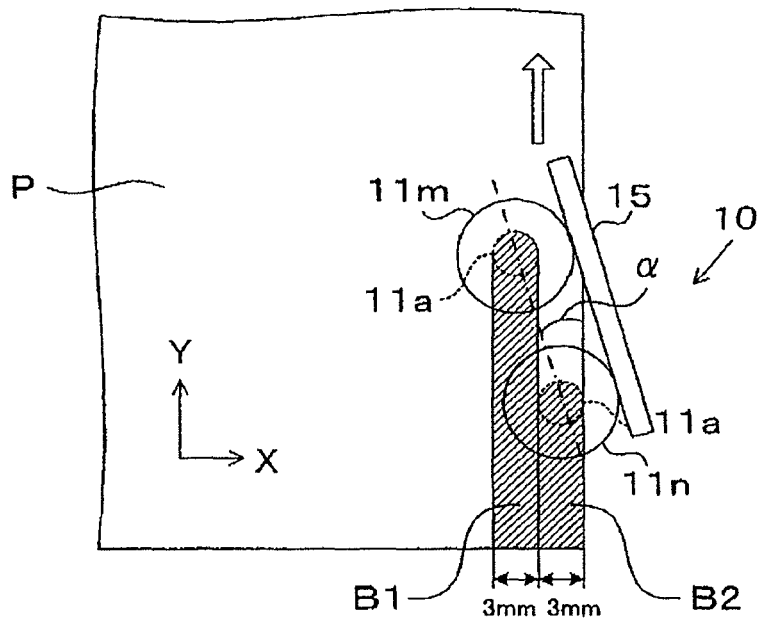
FIG. 4 is an illustrative drawing of the method of sweeping the nozzle over the outer edge of a panel by using the blasting machine of this invention.
Figure 4:
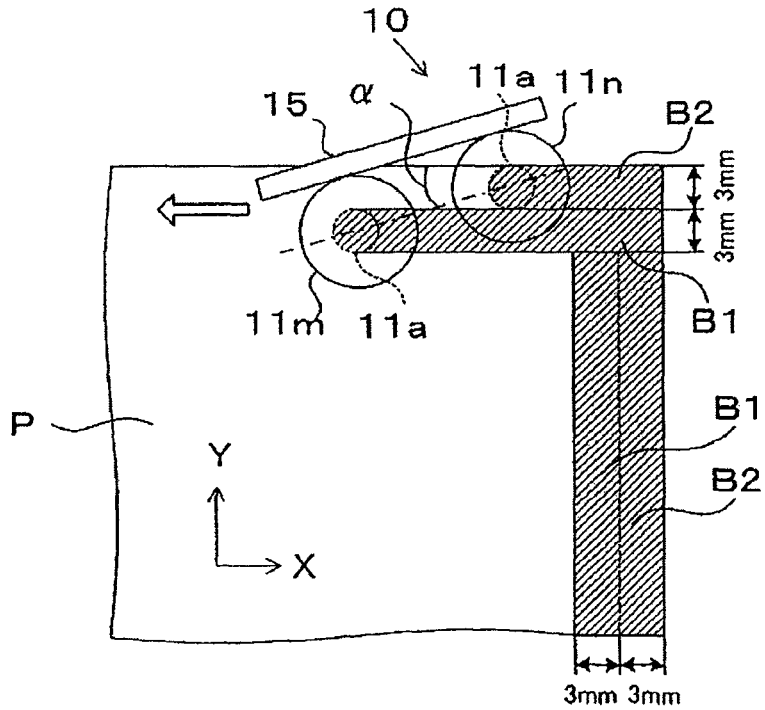
Figure 5:
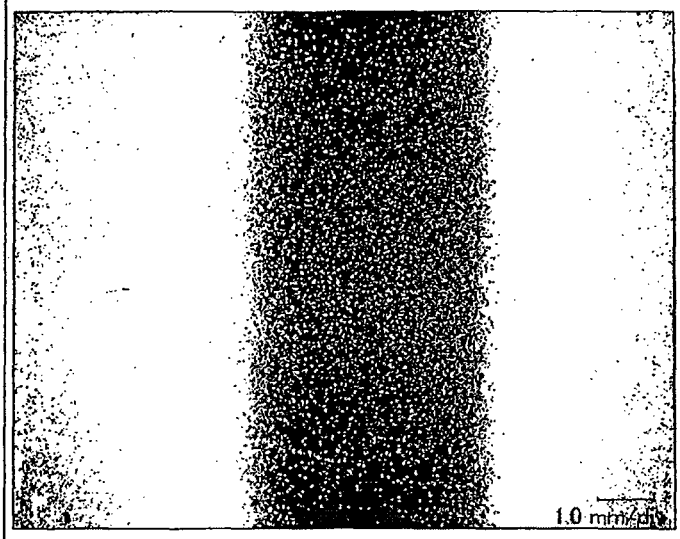
FIG. 5 shows images of reflected electrons that are observed by an electron microscope. The images are enlarged at the boundaries between a blasted area and a non-blasted area.
Figure 5:
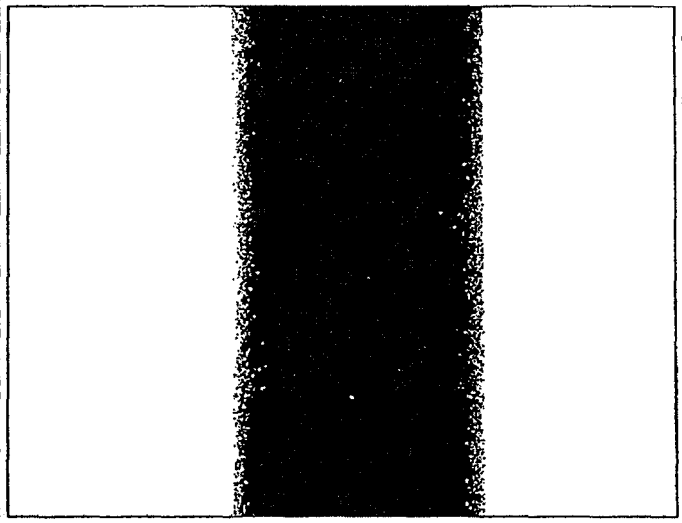
Figure 6:
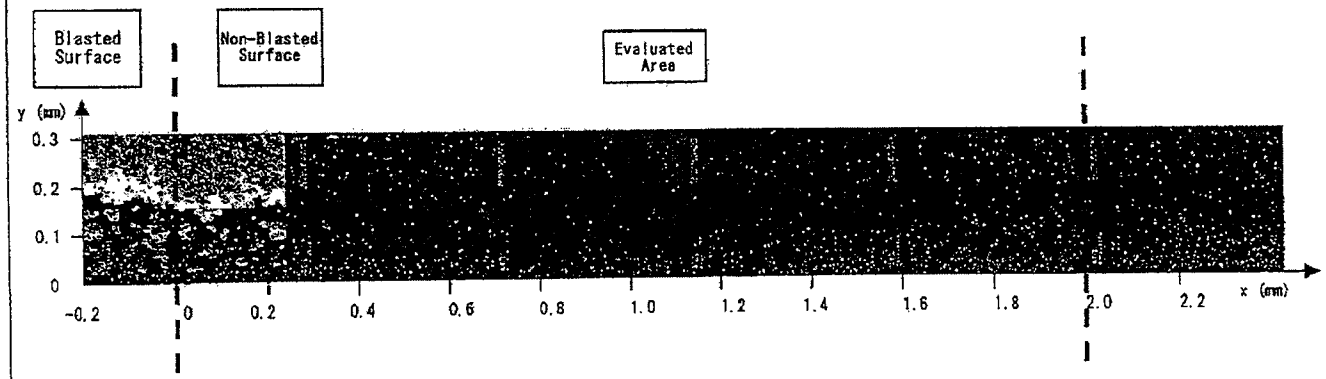
FIG. 6 shows images of secondary electrons that are observed by an electron microscope. The images are enlarged at the boundaries between a blasted area and a non-blasted area.
Figure 6:
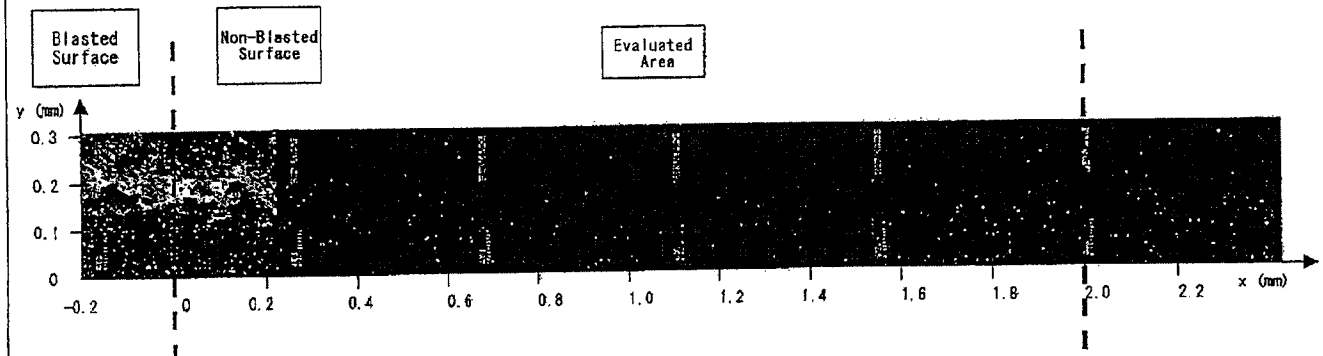
Figure 7:
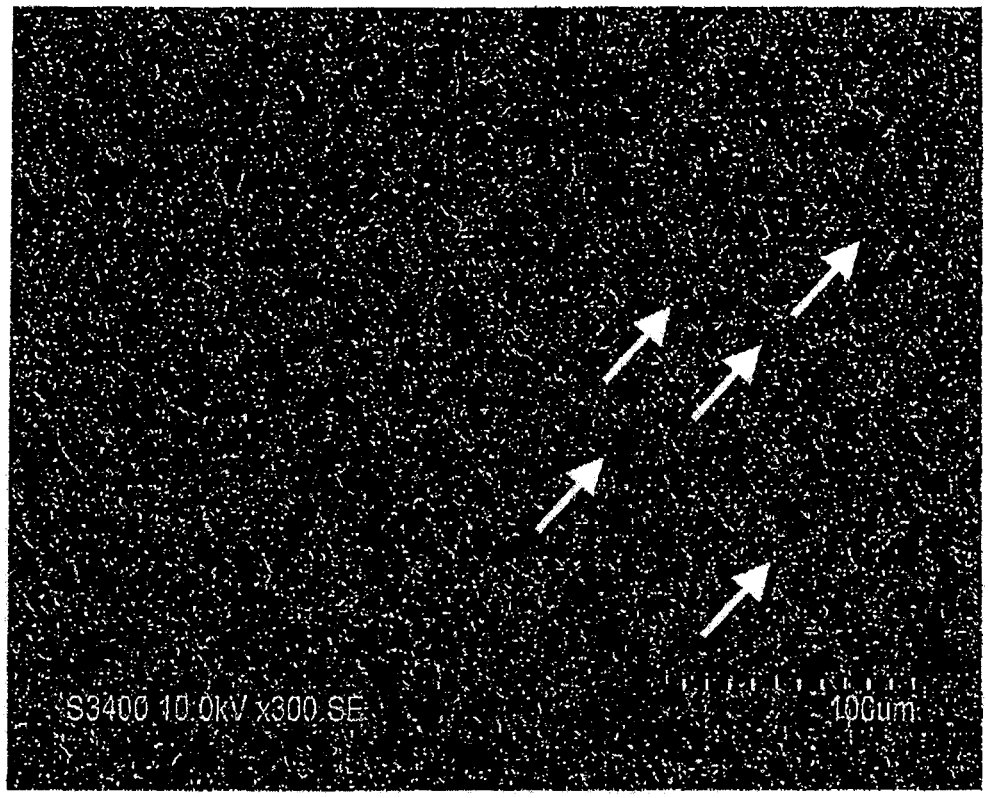
FIG. 7 is an image of flaws to be evaluated that are created at the non-blasted area.

Below, based on the figures, the nozzle, the nozzle unit, and the blasting machine of the first embodiment of this invention are explained. FIG. 1 is an illustrative drawing of the blasting machine. The drawing shows the constitution of the machine. FIG. 2 is an illustrative drawing of the nozzle., The drawing shows the structure of the nozzle. FIG. 3 is an illustrative drawing of the nozzle unit. The drawing shows the structure of the nozzle unit. FIG. 4 is an illustrative drawing of the method of sweeping a nozzle over an outer edge of a panel by using the blasting machine of this invention. FIG. 5 is an image of reflected electrons that are observed by means of an electron microscope. The image is enlarged at the boundary between a blasted area and a non-blasted area. FIG. 6 is an image of secondary electrons that are observed by an electron microscope. The image is enlarged at the boundary between a blasted area and a non-blasted area. FIG. 7 is an image of flaws to be evaluated that are created at the non-blasted area.

Structure of the Blasting Machine

As shown in FIG. 1, the blasting machine 20 comprises the following:

a nozzle unit 10 for blasting abrasives toward works, a chamber for blasting 21 where the works are processed by blasting abrasives, a conveyor 22 for carrying the works to the chamber for blasting 21, a tank for storing the abrasives (not shown), a hopper 23 for the abrasives which supplies a predetermined quantity of the abrasives to a nozzle 11 (see FIG. 2), a compressed-air-supplying apparatus 24 to supply compressed air to the nozzle 11, a classification apparatus 25 for collecting the used abrasives and the dust from the blasted works, and for classifying the reusable abrasives, the non-reusable abrasives, and the dust, and a dust collector 26 for removing the dust from the classification apparatus 25 by vacuuming the apparatus 25.

A carrying-in opening 21*a* for carrying the works into the chamber for blasting 21 and a carrying-out opening 21*b* for carrying the works out the chamber 21 are disposed at the side wall of the chamber 21. Air blowers 21*c* for removing the abrasives from the surfaces of the works are disposed above and below the conveyor 22 near the carrying-out opening 21*b* so that the conveyor 22 is located between the air blowers 21*c*. A device 21*d* for collecting the used abrasives and the dust of the blasted works by vacuuming is disposed at the bottom of the chamber for blasting 21, and connected to the classification apparatus 25.

A sweeping device 21*e* is disposed near the roof of the chamber for blasting 21. The device 21*e* can move the nozzle unit 10 (see FIG. 3) along the direction of the movement of the conveyor 22 ("X-direction"), and the horizontal direction ("Y-direction"), i.e., the direction orthogonal to the X-direction, to sweep the nozzle unit in the chamber for blasting 21.

Structure of the Nozzle and the Nozzle Unit

Below, a nozzle 11, and a nozzle unit 10, which supports the nozzle 11, are explained. As shown in FIG. 2, the nozzle 11 comprises the following:

a compressed-air-supplying pipe 12 communicates with a compressed-air-supplying hose 24*a* that is connected to the compressed-air-supplying apparatus 24, an ejecting portion 13 that includes an ejecting pipe 13*a* for blasting abrasives, and an ejecting-pipe holder 14 that can arrange the compressed-air-supplying pipe 12 and the ejecting pipe 13*a* in a line by means of a space 14*a* for mixing compressed air and abrasives, wherein the distal end of the compressed-air-supplying pipe 12 is inserted into the space 14*a*, and wherein a abrasives-supplying hose 23*a* that communicates with the hopper 23 for the abrasives is connected to the side wall of the ejecting-pipe holder 14 through the port 14*b*.

A portion for escape 13*c* is disposed at the distal end of the ejecting portion 13, wherein the portion for escape is formed so that its outer diameter is continuously decreased along and toward the ejecting port 13*b*, which ejects the abrasives. Since the portion for escape 13*c* is disposed at the distal end of the ejecting portion 13, the abrasives that are blasted to the surface of the work and are reflected from the surface can be prevented from remaining within the space between the surface of the work and the distal end of the ejecting portion 13.

For this embodiment, the portion for escape 13*c* is configured so that it forms a conical surface having an apex angle θ of 50~70° and an axis that correspond to the flow of the abrasives. Since the apex angle of the portion for escape 13*c* ranges from 50 to 70°, the reflected abrasives can easily escape from the space between the surface of the work and the distal end of the ejecting portion 13. For this embodiment, the nozzle 11, which has an apex angle of 70°, an outer diameter of 24 mm, and a length L of 14 mm, of the portion for escape 13*c*, is used.

As shown in FIG. 3, a nozzle unit 10 comprises the following:

two nozzles 11*m*, 11*n*, a support member 15 for supporting the two nozzles 11*m*, 11*n* in parallel, and a rotational device 16 for rotating the support member 15 about an axis H perpendicular to a surface of a work.

Incidentally, for simplification, the compressed-air-supplying hose 24*a* and the abrasives-supplying hose 23*a* are omitted from FIG. 3.

The support member 15 supports the nozzles 11*m*, 11*n* so that the respective distances (for blasting) between the ejecting ports 13*b* of the nozzles 11*m*, 11*n* and the surface of the work become equal, and so that the abrasives are blasted perpendicularly to the surface of the work.

By rotating the support member 15 by means of the rotational device 16, the direction of the row of the nozzles 11*m*, 11*n* can be controlled so that the angle between the direction of the row of the nozzles 11*m*, 11*n* and the direction for sweeping the nozzles can be arbitrarily determined.

For this embodiment, the diameter of the ejecting port 13*b* is 3 mm. The nozzles 11*m*, 11*n* are arranged so that the distance D between the respective centers of the ejecting ports 13*b* of the nozzles 11*m*, 11*n* becomes 40 mm.

A Method for a Blast Processing

Below, a method for blasting abrasives by using the blasting machine 20 of this embodiment is explained. For this embodiment, a solar cell panel is used as a work. A a-Si-type solar cell panel P is made by forming a surface-electrode layer, which is made of ITO (Indium Tin Oxide), then a a-Si layer, and then a back-electrode layer on the surface of the substrates, which substrates are made of glass ("glass substrates"), in this order. An electrical short circuit between the surface-electrode layer and the back-electrode layer is caused at the peripheral edge of the glass substrates because of the disturbance of the state of each layer. Thus, at the peripheral edge of the panel P (the glass substrates), to delete the electrical short circuit, it is necessary that the edge portion of the surface-electrode layer be left as a connecting point for a lead, and that the edge portions of the back-electrode layer and the a-Si layer be removed. For this embodiment, by using a rectangular panel P that is 1,500 mm high×1,100 mm wide×5 mm thick, the blast processing was carried out along the entire peripheral edge, which is 5 mm wide, of the panel P.

Below, the method for the blast processing is explained.

First, after placing the panel P on the conveyor 22, the conveyor 22 is driven, and then the panel P is transferred into the chamber for blasting 21 from the carrying-in opening 21*a* of the chamber 21. Next, the panel P is positioned by a positioning device (not shown) so that the respective sides of the panel P are oriented in parallel to the X-direction and the Y-direction.

Next, the nozzle unit 10 is positioned at the predetermined starting point of the blast processing by means of the sweeping device 21*e*. While the nozzles 11*m*, 11*n* sweep over the peripheral edge of the panel P at the predetermined speed by the method that is explained below, the nozzles 11*m*, 11*n* then blast abrasives, which are abrasive alumina grains having a mean grain size of 24 μm, onto the peripheral edge of the panel P, which is 6 mm wide, to remove the thin layers on the peripheral edge. For this embodiment, the conditions of the blast processing are as follows:

Pressure for Blasting: 0.5 Mpa

Quantity of Abrasives to be Supplied: 250 g/min.

Distance between Nozzles and a Work: 2.5 mm

These conditions are controlled by a control device (not shown) installed on the blasting machine 20.

The blast processing is performed based on the method explained below.

Compressed air is provided to the compressed-air-supplying pipe 12 of the nozzles 11*m*, 11*n* through the compressed-air-supplying hose 24*a* from the compressed-air-supplying apparatus 24. Then the compressed air is ejected from the distal end of the compressed-air-supplying pipe 12 toward the ejecting pipe 13*a*.

The quantity of the abrasives to be supplied is controlled by the hopper 23, which holds the abrasives. The abrasives are supplied to the space 14*a* for mixing compressed air and abrasives of the ejecting-pipe holder 14 of the nozzles 11*m*, 11*n* through the abrasives-supplying hose 23*a* by means of the negative pressure that is caused when the compressed air passes through the space 14*a* from the compressed-air-supplying pipe 12. The abrasives supplied to the space 14*a* are mixed with the compressed air ejected from the compressed-air-supplying pipe 12, and then are accelerated and blasted toward the work from the ejecting port 13*b* through the ejecting pipe 13*a*. The blasted abrasives hit the predetermined place on the surface of the work. In this way, the blast processing is carried out.

The used abrasives and the dust of the blasted works, which are scattered after hitting the works, are recovered from the device 21*d* by vacuuming the device 21*d* by means of a fan for the dust collector 26, and then are conveyed to the classification apparatus 25 by means of air, and classified. The reusable abrasives have a predetermined grain size. The abrasives are classified by the classification apparatus 25, and are returned to the tank, for storing the abrasives, of the hopper 23, to be reused.

After blasting abrasives toward the peripheral edge of the panel P, the panel P is taken out from the chamber for blasting 21 through the carrying-out opening 21*b* by means of the conveyor 22. Then the blast processing is completed. Then, the abrasives attached to the panel P are blown off by the air blowers 21*c*, which are disposed near the carrying-out opening 21*b* and within the chamber for blasting 21, and removed from the panel P. Since the pressure in the chamber for blasting 21 is negative, the abrasives and the dust do not leak from the carrying-out opening 21*b*.

Next, the method for sweeping the nozzles 11*m*, 11*n* is explained based on FIG. 4. FIG. 4 is an illustrative drawing of a view from above the nozzles 11*m*, 11*n*. The nozzles 11*m*, 11*n* are supported by the support member 15 so that the distance between the nozzles 11*m*, 11*n* and the work is less than 5 mm. For this embodiment, the distance is 2.5 mm. In this way, since the distance between the nozzles 11*m*, 11*n* and the work is short, the flow of the abrasives hardly spreads. Thus, the abrasives are blasted only onto an area having a diameter of 3 mm, which is the same size of that of the ejecting port 13*b*. Further, since the portion for the portion for escape 13*c* is formed at the distal end of the ejecting portion 13, the abrasives reflected from the surface of the work do not remain within the space between the surface of the work and the distal end of the ejecting portion 13. Thus, when the nozzles sweep over the panel P in one direction, the nozzles can be controlled to blast the panel P so that the respective nozzles blast the area having a band-like shape, which is 3 mm wide, with high dimensional accuracy.

To blast the abrasives on the peripheral edge along the Y-direction of the panel P, the nozzle unit 10 is positioned above the corner of the panel P by means of the sweeping device 21*e*. Next, as shown in FIG. 4(A), the angle α is determined so that the total width of the area B1, which has a band-like shape to be blasted by the nozzle 11*m*, and the area B2, which has a band-like shape to be blasted by the nozzle 11*n*, is 6 mm. Then, the support member 15 is rotated about the axis H by means of the rotational device 16. The angle α is defined as the angle between the direction for sweeping the nozzles 11*m*, 11*n* and the direction connecting the respective centers of the nozzles 11*m*, 11*n*. For this embodiment, the total width of the area having a band-like shape to be blasted is set at 6 mm. However, that total width can be freely changed within the range of 3-6 mm by changing the angle α by means of the rotational device 16.

Then, while blasting the abrasives, the nozzle unit 10 sweeps along the Y-direction by means of the sweeping device 21*e*. Consequently, the area having a band-like shape 6 mm wide can be processed while the nozzle unit 10 sweeps one time. Thus, the efficiency of the blast processing can be improved. Further, since the respective ejecting ports 13*b* of the nozzles 11*m*, 11*n* are placed apart from each other, the abrasives blasted from the respective nozzles do not interfere with each other, and the dimensional accuracy of the blast processing can be improved.

Next, as shown in FIG. 4(B), the support member 15 is rotated counterclockwise as viewed from above, by the rotational device 16. Then, while the nozzles 11*m*, 11*n* sweep along the X-direction by means of the sweeping device 21*e*, the abrasives are blasted for the blast processing of the panel P. Consequently, like the blast processing in the Y direction, the area having a band-like shape 6 mm wide of the peripheral edge of the panel P can be processed while the nozzle unit 10 sweeps one time.

Similarly, the two remaining sides of the peripheral edge of the panel P can be blasted. Consequently, the blast processing for the entire peripheral edge of the panel P can be completed. In this way, by the blasting machine of this invention, since the portion for escape 13*c* is formed at the distal end of the ejecting portion 13, if the nozzle 11 is moved closer to the surface of the work to suppress the broadening of the flow of the abrasives blasted from a nozzle, the abrasives that are reflected from the surface of the work cannot remain within the space between the surface of the work and the distal end of the ejecting portion 13. Thus, the work can be processed with high dimensional accuracy. Further, by adjusting the positioning of the nozzles 11*m*, 11*n* so as to correspond to the width of the area having a band-like shape to be processed, since one side of the peripheral edge of the panel P can be processed while the nozzles 11*m*, 11*n*, sweep one time, the productivity of the blasting process can be improved. Namely, both the improvement of the dimensional accuracy and the productivity of the blast processing can be achieved.

For this embodiment, the portion for escape 13*c* is formed so that it has a conical shape. However, the shape of the clearance 13*c* is not limited to that one. The shape of the clearance 13*c* may be such that the abrasives reflected from the surface of the work do not remain at the space between the surface of the work and the distal end of the ejecting portion 13. For example, the edge of the distal end of the ejecting portion 13 may be chamfered, or the portion for escape 13*c* may have a curved shape, instead of a conical shape.

The method for supporting the nozzles 11*m*, 11*n* is not limited to that shown in FIG. 3(A). For example, the nozzles 11*m*, 11*n* may be mounted on the circular plate attached to the distal end of the support member 15.

The mechanism for rotating the nozzles of the rotational device 16 may be driven by either electric power or manually, in so far as the device 16 can control the angle α.

Below, examples of the first embodiment of this invention and a comparative example are explained. Incidentally, the present invention is not limited to the following examples.

The blast processing was carried out on the glass substrate that was coated with thin films for a a-Si-type solar cell, which is explained in Paragraph [0031], by using one nozzle. The conditions of the blast processing are shown in Table 1. The nozzle 11, used for the first embodiment, which nozzle has the portion for escape 13*c*, has an apex angle of 70°. The nozzle used in the comparative embodiment does not have the portion for escape 13*c*, but is a straight-type nozzle. The diameter of the thicker portion of the nozzles (the maximum diameter) and the inner diameter of the ejecting port 13*b* (the inner diameter of the nozzles) were 24 mm and 4 mm, respectively. The distances for blasting abrasives, which are the same as the distances between the ejecting port 13*b* and the glass substrate, were set at 2.5 mm and 3.0 mm. The abrasives were WA #600, which is produced by Sintobrator, Ltd., made of alumina, and have a mean grain size of 25 μm.

TABLE 1

| | |
|---|---|
| Abrasives | WA#600 |
| Pressure of Air | 0.6 MPa |
| Ratio of Mixture | 0.17 |
| Speed for Scanning Nozzle | 200 mm/sec |
| Angle of Nozzle against Surfaces of Works | 90 degrees |

An evaluation of the blast processing was carried out based on whether the thin films were able to be removed from the surface of the substrate, and whether flaws were caused at the thin films at the areas that were not treated by the blast processing.

Regarding the evaluation of the blast processing based on whether the thin films were able to be removed from the surface of the substrate, it was determined based on whether the boundary between the blasted area and the non-blasted area was clear. FIG. 5 shows the images of reflected electrons that were observed by an electron microscope. The images are enlarged at the boundaries between the blasted area and the non-blasted area. If the boundary between the blasted area and the non-blasted area was unclear, as shown in the upper image of FIG. 5, the evaluation of the blast processing was negative (X). In contrast, if the boundary was clear, as shown in the lower image of FIG. 5, the evaluation of the blast processing was positive (○). The lower image and the upper image of FIG. 5 are the result of the embodiment 1-1 and the comparative embodiment, respectively, which are explained below.

Regarding the evaluation of the blast processing based on whether flaws were caused at the thin films at the areas that were not treated by the blast processing, it was determined based on whether there were distinguishable flaws at the belt-like area (the area for evaluation) that is 2 mm wide and that extends from the boundary between the blasted area and the non-blasted area toward the non-blasted area. FIG. 6 shows the images of secondary electrons that are observed by an electron microscope. These images are enlarged at the boundaries between the blasted area and the non-blasted area. The flaws to be evaluated were defined as the portions having a point-like shape or a linear shape that were observed as spotty areas being blackish against the color tone of the entire surface of the substrate, and as depressed areas. As shown in the upper image of FIG. 6, if the flaws were highly visible within the area for evaluation, the evaluation of the blast processing was negative (X). In contrast, if the flaws were not visible within the area for evaluation, the evaluation of the blast processing was positive (○). The lower image and the upper image of FIG. 6 are the result of the embodiment 1-1 and the comparative embodiment, which are explained below, respectively.

The results of the evaluation are shown in Table 2. When the nozzle for the comparative embodiment, which nozzle does not have the portion for escape 13*c*, but is a straight-type nozzle, were used, the results of both the evaluation regarding the removal of the thin films and the flaws at the area for evaluation were negative (X). In contrast, when the nozzle 11 for examples 1-1 and 1-2, which nozzle 11 has the portion for escape 13*c*, were used, the results of both the evaluation of the removal of the thin films and flaws at the area for evaluation were positive (○). Thus, the effects of this invention were confirmed based on these results. The shorter the distance for blasting abrasives is, the sharper the boundary between the blasted area and the non-blasted area will be. However, flaws are likely to be caused on the thin films. For this embodiment of this invention, when the distance for blasting abrasives is very short, such as 2.5 mm, no flaws were caused on the thin films. Thus, the excellent blast processing can be achieved.

TABLE 2

| Example No. | Inner Diameter of Nozzle | Angle of Apex of Nozzle | Distance for Blasting Abrasives (l) | Removal of Thin Films | Flaws on Thin Films |
|---|---|---|---|---|---|
| Example 1-1 | 4 mm | 70 degrees | 2.5 mm | ○ | ○ |
| Example 1-2 | | | 3.0 mm | ○ | ○ |
| Comparative Example | 4 mm | 0 degrees | 2.5 mm | X | X |

The first embodiment of this invention has the following effects:

(1) By the nozzle 11 of this invention, since the portion for escape 13*c* is formed at the distal end of the ejecting portion 13, if the distance between the surface of the work and the nozzle 11 is shortened to suppress the broadening of the flow of the abrasives, the reflected abrasives do not remain within the space between the surface of the work and the distal end of the ejecting portion 13. Thus, the blasting process with a high precision can be achieved. Particularly, it is preferable that the portion for escape 13*c* have a conical surface having an apex angle of 50~70°.

(2) By the nozzle unit 10 and the blasting machine 20 of this invention, since the nozzle 11*m* and the nozzle 11*n* can be arranged so as to correspond to the width of the surface of the work to be processed by the rotational device 16, it is possible to blast a wider area of the surface of the work while the nozzle unit or the blasting machine sweeps one time. Thus, the blasting process can achieve a high productivity.

Second Embodiment

Figure 8:
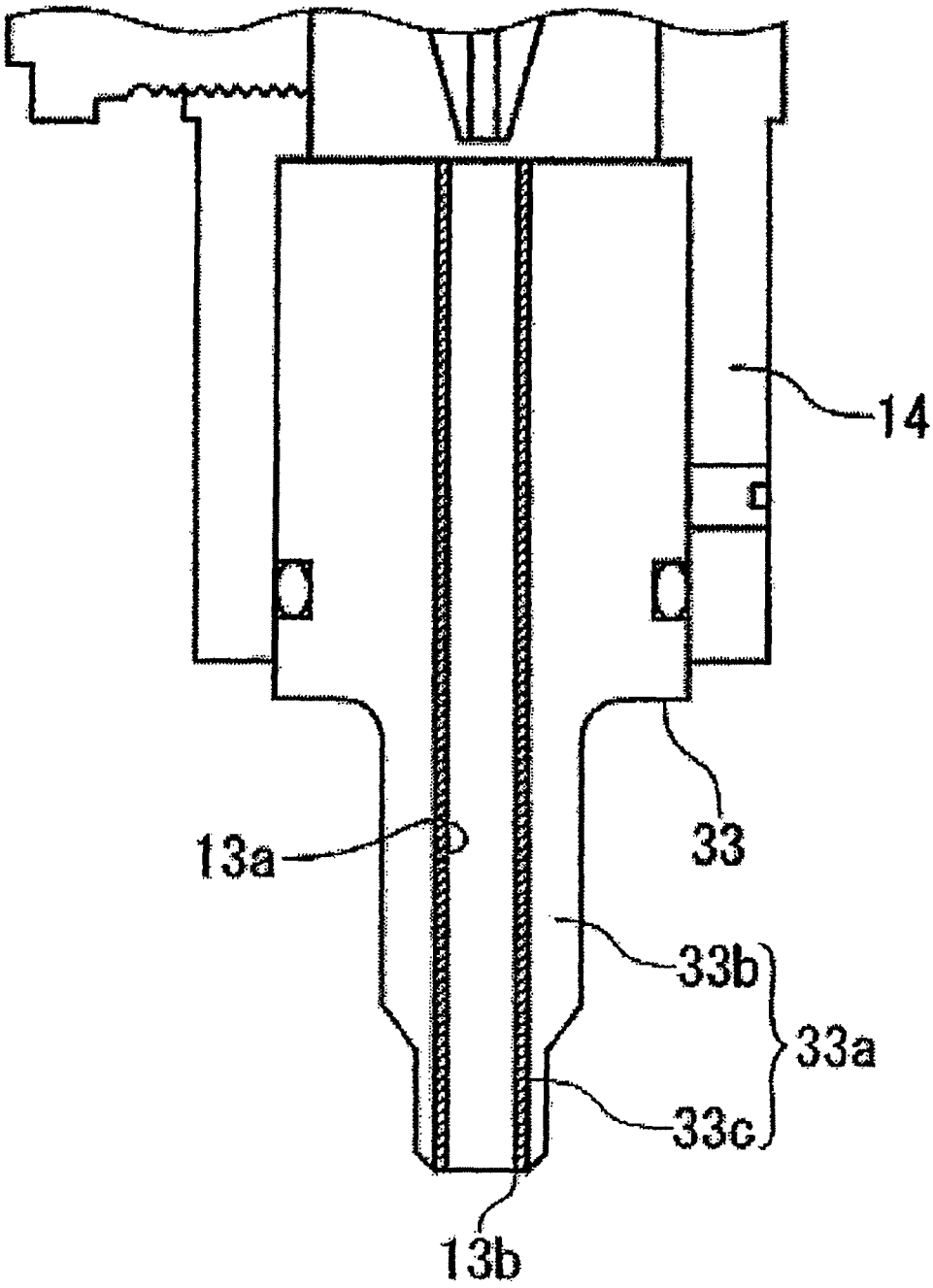
FIG. 8 shows the second embodiment of the shape of the ejecting portion of this invention.

Below, the second embodiment of this invention is explained based on FIG. 8. FIG. 8 shows that the second embodiment has the shape of the ejecting portion.

Only the shape of the ejecting portion disposed at the distal end of the nozzle of the second embodiment differs from that of the first embodiment. Thus, only that difference is explained below.

The shape of the ejecting portion 33 of the second embodiment is shown in FIG. 8. A portion for escape 33*a*, which corresponds to the portion for escape 13*c* of the first embodiment, is disposed at the ejecting portion 33.

For the second embodiment, the outer diameter of the portion for escape 33*a* is less than that of the part of the ejecting portion 33, which is fixed by the ejecting-pipe holder 14. The portion for escape 33*a* is comprised of a first circular pipe 33*b*, which has a cylindrical surface having a constant outer diameter, and a second circular pipe 33*c* disposed at the side of the distal end of the nozzle and connected to the first circular pipe 33*b*. The pipe 33*c* has a cylindrical surface having an outer diameter that is less than the outer diameter of the first circular pipe 33*b*. Namely, the portion for escape 33*a* of the ejecting portion 33 should be formed so that the nearer to the ejecting port 13*b* the circular pipe is, the smaller the outer diameter of the circular pipe is, step wise. For example, the first circular pipe 33*b* and the second circular pipe 33*c* may be formed so that the first circular pipe 33*b* has an outer diameter of 11 mm and a length of 18 mm, and the second circular pipe 33*c* has an outer diameter of 7 mm and a length of 10 mm.

By placing the portion for escape 33*a* at the distal end of the ejecting portion 33, the abrasives that hit the surface of the work and then reflected are prevented from remaining between the ejecting portion 33 and that surface.

As shown in FIG. 8, an inclined portion may be disposed between the first circular pipe 33*b* and the second circular pipe 33*c* by forming a tapered portion. The distal end of the second circular pipe 33*c* may be formed so that it has the same conical shape as that of the portion for escape 13*c*. These approaches will help to effectively prevent the abrasives that are reflected from the surface of the work from remaining between the ejecting portion 33 and that surface. Further, although FIG. 8 shows the ejecting portion 33, which has the two circular pipes, the configuration of the ejecting portion 33 is not limited to that. A configuration having one circular pipe or three or more circular pipes may also be used for the ejecting portion 33. When the ejecting portion 33 has three or more circular pipes, it should be formed so that the nearer to the ejecting port 13*b* the circular pipe is, the smaller the outer diameter of the circular pipe is, step wise.

The nozzle that has the ejecting portion 33 of the second embodiment may be used for the blasting machine 20, which has the same constitution as that of the first embodiment of this invention. The blasting machine 20, which uses the nozzle of the second embodiment, has the same effects as those of the first embodiment.

Below, examples of the second embodiment of this invention are explained. Incidentally, the present invention is not limited to the following examples.

The blast processing was performed on a glass substrate that was coated with thin films for producing a a-Si-type solar cell, by using one nozzle. The conditions of the blast processing are shown in Table 1. They are the same as those of the first embodiment. The following three types of nozzles were used for the examples:

Type 1:

Inner Diameter of the Nozzle: 4 mm;

Length of the Portion for Escape 33*a:* 28 mm

Type 2:

Inner Diameter of the Nozzle: 4 mm;

Length of the Portion for the Portion for Escape 33*a:* 42 mm

Type 3:

Inner Diameter of the Nozzle: 6 mm;

Length of the Portion for Escape 33*a:* 28 mm

The distance for blasting abrasives was set from 2.5 mm to 4.0 mm.

Evaluation of the blast processing was carried out based on the same method as that of the first embodiment. The results of the evaluation are shown in Table 3. For examples 2-1 to 2-8, the evaluations for both removal of thin films and for flaws on thin films were positive (○). Thus, the effects of this invention were verified by these examples.

TABLE 3

| Example No. | Inner Diameter of Nozzle | Length of a Portion 33a | Distance for Blasting Abrasives (l) | Removal of Thin Films | Flaws on Thin Films |
|---|---|---|---|---|---|
| Example 2-1 | 4 mm | 28 mm | 2.5 mm | ○ | ○ |
| Example 2-2 | | | 3.0 mm | ○ | ○ |
| Example 2-3 | | | 3.5 mm | ○ | ○ |
| Example 2-4 | | | 4.0 mm | ○ | ○ |
| Example 2-5 | | 42 mm | 2.5 mm | ○ | ○ |
| Example 2-6 | | | 3.0 mm | ○ | ○ |
| Example 2-7 | | | 3.5 mm | ○ | ○ |
| Example 2-8 | 6 mm | 28 mm | 3.0 mm | ○ | ○ |

The second embodiment of this invention has the following effects:

(1) Since the portion for escape 33*a*, which corresponds to the portion for escape 13*c*, is formed at the ejecting portion 33, if the distance between the surface of the work and the nozzle 11 is shortened to suppress the broadening of the flow of the abrasives, the reflected abrasives do not remain within the space between that surface and the ejecting portion 33. Thus, the blasting process with a high precision can be achieved.

(2) In the same way as that of the first embodiment, since the nozzle 11*m* and the nozzle 11*n* can be arranged so as to correspond to the width of the surface of the work to be processed by the rotational device 16, it is possible to blast a wider area of the surface of the work while the nozzle unit sweeps one time. Thus, the blasting process can achieve a high productivity.

Another Embodiment

For the first and the second embodiment explained in the above paragraphs, the two nozzles, each having the ejecting port 13*b* with the same diameter, are used for the blasting machine 20. However, the blasting machine 20 may use a nozzle unit that comprises nozzles where the ejecting ports 13*b* have different diameters. Further, the blasting machine 20 may use more than three nozzles that are arranged at arbitrary positions.

It is not necessary to continuously blast the abrasives from all of the nozzles of the blasting machine 20. The blast processing may be carried out by blasting the abrasives from the specified nozzles at a predetermined time. Consequently, the blast processing may be performed in various processing patterns.

For the embodiment explained in the above paragraphs, a suction-type nozzle is used for the nozzle unit 10 and the blasting machine 20. However, the present invention may be applied to a compressed-air-type nozzle, which can blast the abrasives by the compressed air provided to the tank for storing the abrasives of the hopper after measuring the quantity of the abrasives.

What we claim is:

1. A nozzle unit having a plurality of the nozzles for use in a blast processing that blasts abrasives toward a surface of solar cell panel, each of the nozzles comprising:

an ejecting portion having an ejecting port for blasting abrasives, which ejecting portion is located at a distal end of the nozzle, and a portion for escape, which surrounds the ejecting portion of the nozzle, wherein the portion for escape is formed so that an outer diameter of a cross section of a portion for escape perpendicular to a flow of the blasted abrasives decreases toward the ejecting port, and wherein the portion for escape can prevent abrasives that are blasted toward the surface of a work by the nozzle and are reflected from the surface from remaining within a space between the surface of the work and a distal end of the ejecting portion of the nozzle because of collisions of the reflected abrasives with the distal end of the ejecting portion, wherein the portion for escape that surrounds the ejecting portion of the nozzle is formed of a plurality of portions for escape each portion having a constant outer diameter, wherein an outer diameter of a portion for escape near the distal end of the ejecting portion is smaller than an outer diameter of another portion for escape near a proximal end of the ejecting portion, wherein the plurality of portions for escape comprises a first circular pipe having a cylindrical surface having a constant outer diameter, the diameter of the first circular pipe being smaller than a diameter of the ejecting portion at the proximal end of the ejecting portion, and a second circular pipe having a cylindrical surface having a constant outer diameter, the second circular pipe being at the distal end of the ejecting portion and connected to the first circular pipe, the outer diameter of the second circular pipe being smaller that the outer diameter of the first circular pipe, wherein a distal end of the second circular pipe near the ejecting port is formed to have a conical surface, having an apex angle of 50-70°, wherein an inclined, tapered portion is located between the first circular pipe and the second circular pipe, and the nozzle unit further comprises:

a support member for supporting the plurality of nozzles in parallel so that the nozzles can perpendicularly blast the abrasives toward the surface of the work, and a rotational device for rotating the support member about an axis perpendicular to the surface of the work, wherein a total width of areas blasted from the plurality of nozzles is adjusted by an angle at which the support member is rotated about the axis that is perpendicular to the surface of the work, which rotation is caused by means of the rotational device.

2. A blasting machine having the nozzle unit of claim 1, wherein the blasting machine blasts abrasives toward the surface of the work from the nozzles, and carries out the blast processing of the surface of the work while the nozzles sweep over the work.

* * * * *